US007040215B2

(12) United States Patent
Bruck

(10) Patent No.: US 7,040,215 B2
(45) Date of Patent: May 9, 2006

(54) CONTROL DEVICE FOR A WORKING DEVICE CONNECTED TO A HYDRAULIC CIRCUIT

(75) Inventor: Peter Bruck, Althombach (DE)

(73) Assignee: Hydac Fluidtechnik GmbH, Sulzbach/Saar (DE)

( * ) Notice: Subject to any disclaimer, the term of this patent is extended or adjusted under 35 U.S.C. 154(b) by 0 days.

(21) Appl. No.: 10/466,301

(22) PCT Filed: Jan. 10, 2002

(86) PCT No.: PCT/EP02/00155

§ 371 (c)(1),
(2), (4) Date: Nov. 13, 2003

(87) PCT Pub. No.: WO02/055426

PCT Pub. Date: Jul. 18, 2002

(65) Prior Publication Data

US 2004/0065081 A1 Apr. 8, 2004

(30) Foreign Application Priority Data

Jan. 15, 2002 (DE) ..... 101 02 409

(51) Int. Cl.
*F15B 11/04* (2006.01)

(52) U.S. Cl. ..... 91/435; 91/DIG. 2

(58) Field of Classification Search ..... 91/435, 91/DIG. 2

See application file for complete search history.

(56) References Cited

U.S. PATENT DOCUMENTS 3,126,031 A * 3/1964 Hayner ..... 91/435
4,250,794 A * 2/1981 Haak et al. ..... 91/420

FOREIGN PATENT DOCUMENTS

| | | |
|---|---|---|
| DE | 3708143 | 9/1988 |
| DE | 4239321 | 5/1994 |
| EP | 0743460 | 11/1996 |

* cited by examiner

*Primary Examiner*—F. Daniel Lopez
(74) *Attorney, Agent, or Firm*—Roylance, Abrams, Berdo & Goodman, L.L.P.

(57) ABSTRACT

A control device for a working device (12) connected to a hydraulic circuit (10), especially for a load fork (16) which can be raised and lowered with a working cylinder (14) in a fork-lift truck. A valve control unit moves into an adjustment position when the load fork (16) is lowered even when carrying a load (18). A predefinable maximum volume flow is maintained in the hydraulic circuit (10). By providing the valve control unit with a pressure regulator (26) limiting a pilot control pressure for the control valve (28), once a predefinable regulating pressure differential is reached in the hydraulic circuit, the control valve moves into a regulating position to maintain the maximum volume flow. The known flow control valve is replaced in the main flow by a pressure regulator (26) disposed in the pilot control circuit (40), and only needs to be dimensioned for low volume flows. As a result, the control system can be constructed using simple, low-cost components which operate in a functionally reliable manner and enable stable control behavior.

12 Claims, 3 Drawing Sheets

CONTROL DEVICE FOR A WORKING DEVICE CONNECTED TO A HYDRAULIC CIRCUIT

FIELD OF THE INVENTION

The present invention relates to a control device for a working device connected to a hydraulic circuit, particularly for a load fork of a forklift which may be raised and lowered by an operating cylinder. In the control device, a valve control unit which assumes a normal position when the forklift is lowered, even when under a load. A predetermined maximum volume flow is maintained in the hydraulic circuit in that position.

BACKGROUND OF THE INVENTION

Seat valves with a constant opening pattern often participate in proportional load lowering of load forks of forklifts. The seat valves involved may be actuated directly or under pilot control. Use of seat valves is necessary, since forklift manufacturers require a so-called "lift-dense" load retention because only very slight leakage is permissible. Preventing leaks in the hydraulic circuit ensures that the load fork cannot be lowered independently, with or without load, something which would present a safety problem. The function of restricting the maximum volume flow independently of the load is assumed in the conventional solutions by a constant-volume flow regulator connected in series to the other components of the hydraulic circuit.

The control devices used for this purpose presently are disadvantageous. During lowering of the load fork when empty, only the dead weight of the moving parts, especially that of the load fork, is available on the lift mast to send the hydraulic fluid from the operating cylinder (plunger cylinder) back to the tank as a component of the hydraulic circuit. The pressure on the cylinder may drop to values<8 bar in certain lift mast configurations.

The greater the number of components through which the flow must progress during lowering, the lower is the volume flow. The conventional constant-volume flow regulator presents a particularly great obstacle, since the aperture selected for the regulator must be so small that a control pressure difference of at least 7 bar may be established. Lower control pressures would result in unstable behavior in the hydraulic circuit and may also be unacceptable for safety reasons. Another problem is presented by the falling characteristic required by the customer for the volume flow regulator. Consequently, for considerations of safety and practicability, it must be ensured that the lowering speed will decrease with increases in the load. While this is effected by the constant-volume flow control unit in the conventional control devices, in theory this arrangement as well results in increased instability within the hydraulic circuit.

DE 37 08 143 C1 discloses a safety circuit for the control circuit of a power lift. In the circuit, the position of the hydraulic jack is assigned a nominal value as a function of the pressure differential between adjacent control lines. The pressure in a control line is affected by a load receiving element, and the pressure level in the power lines is affected by a nominal value transmitter. A control circuit is provided by which the drive of the working chamber of the power lift is disconnected from the control valve when the pressure medium supply circuit is disconnected. This switching state is maintained after starting of the pressure medium supply circuit until the desired value set at the nominal value transmitter is brought to the actual position value. This arrangement ensures reliable prevention of unintentional raising or lowering of an operating device mounted on a tractor after the tractor has been started, because an adjustment of the nominal value transmitter has inadvertently been made with the pressure medium supply circuit disconnected. Damage and accidents are thereby excluded. In the case of the conventional solution, however, the lowering behavior of the operating device is as unfavorable as in the case of the technical solutions in this field as described.

SUMMARY OF THE INVENTION

Objects of the present invention are to provide an optimal control devices achieving improved lowering behavior for an operating device of a machine, especially for a load fork of a forklift, while maintaining the desired stability criteria for the hydraulic circuit.

These objects are attained by a control device where a valve control unit is provided with a pressure regulator. When a predetermined control pressure differential in the hydraulic circuit limits the pilot control pressure for a control valve so that this control valve assumes a normal position for maintaining the maximum volume flow, the conventional flow control valve in the main flow is replaced by a pressure regulator in the pilot control circuit which needs to be configured only for low volume flows. Consequently, the control system may be produced with simple and cost-effective components which are also dependable in operation and permit a stable control behavior. In addition, by the present invention, the volume flow during lowering of the operating device, such as one in the form of a load fork, may be appreciably increased even when the device carries no load, so that no obstacles may arise in operation during lowering. Reduction of the lowering volume flow at the same pilot control pressure as that of the load increases is also achieved. This arrangement results in a characteristic curve of the system such that the operator of the forklift requires more adjusting distance to reach the same lowering speed for the load fork as the load increases. The degressive control behavior involved on the part of the operator is desirable for safety reasons and is achieved immediately with the control device of the present invention.

The control device of the present invention uses a pilot-controlled seat valve controlled by a proportional pressure reducer as the control aperture for a maximum volume flow restriction integrated into the system. Preferably, a measuring nozzle screw-mounted in the control unit of the operating device may be used as orifice gauge which must be designed for a control pressure differential of only 3 to 4 bar. The pressure differential of the measuring nozzle is monitored by the pressure regulator in the pilot control circuit of the seat valve. When the pilot differential pressure is reached, the pressure regulator opens, thereby limiting the maximum pilot control pressure of the seat valve. The respective lift of the seat valve then assumes a normal position for maintaining the maximum volume flow.

Other objects, advantages and salient features of the present invention will become apparent from the following detailed description, which, taken in conjunction with the annexed drawings, discloses preferred embodiments of the present invention.

DETAILED DESCRIPTION OF THE INVENTION

Figure 1:
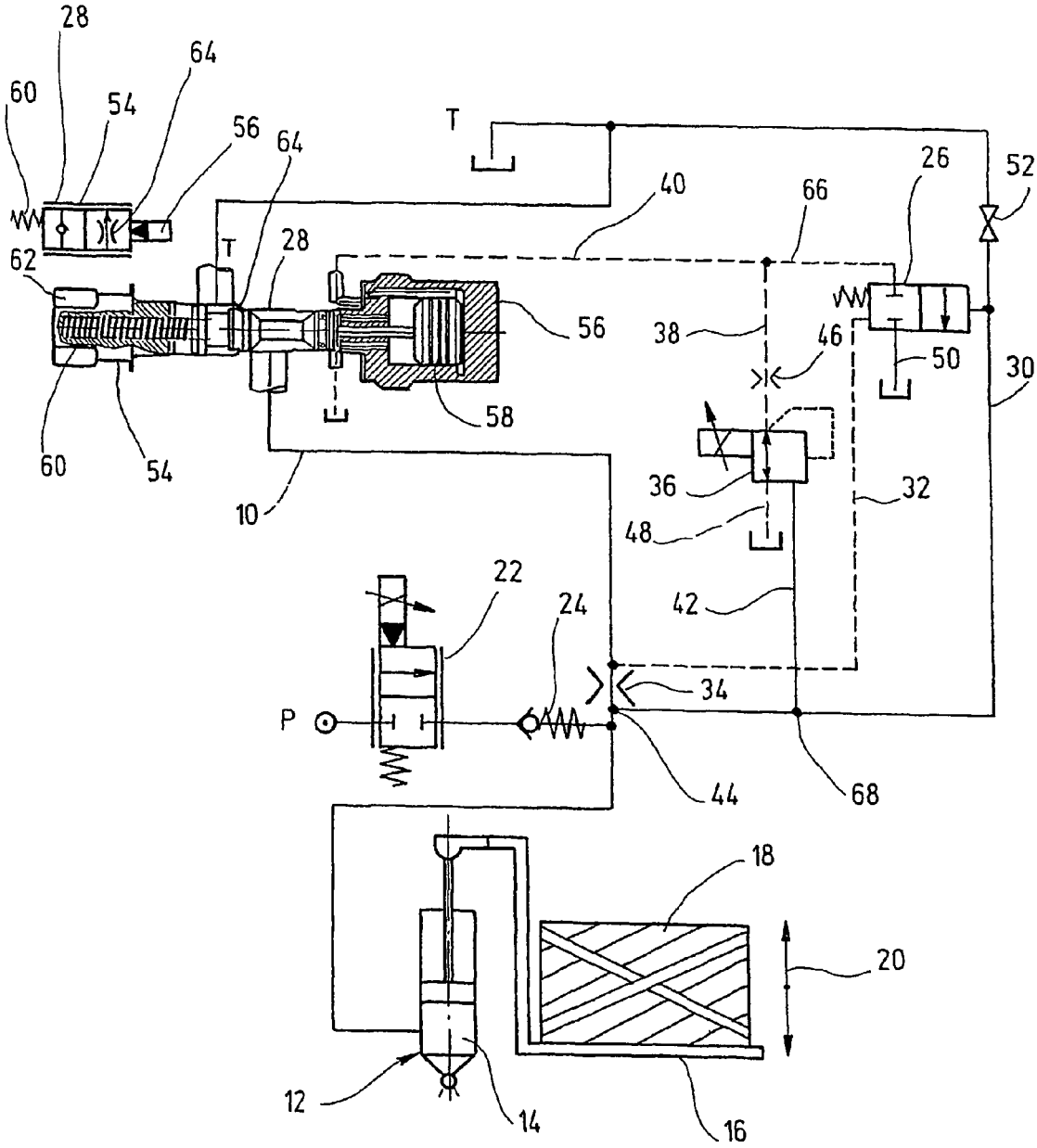
FIG. 1 is a schematic circuit diagram illustrating the circuitry of the control device according to a first embodiment of the present invention.

A control device according to an embodiment of the present invention has a closed hydraulic circuit 10 with a hydraulic pump P for fluid and pressure supply and a tank T for fluid storage. The hydraulic circuit 10 is connected to an operating device, designated as a whole as 12, which has a conventional operating cylinder 14 for raising and lowering a load fork 16 of a forklift of conventional design (not shown). The load fork 16 may be provided on its upper side with a load 18. The directions of lifting and lowering the load fork 16 are indicated in FIG. 1 by arrows 20. If the lift valve 22 is selected, it is connected for the hydraulic medium to be fed into the operating cylinder 14 under pressure. The return valve 24 is open, and thus, the load fork 16 is lifted together with its load 18.

The control device is provided with a valve control unit, which assumes a normal position when the load fork 16 carrying the load 18. That normal position maintains a predetermined maximum volume flow in the hydraulic circuit 10. The valve control unit is provided for this purpose with a pressure regulator 26 which, when a predetermined control differential is reached in the hydraulic circuit 10, limits the pilot control pressure for a control valve 28 so that this valve assumes a normal position for maintaining the maximum volume flow. The pressure regulator 26 has its two control connections 30 and 32 upstream and downstream from an orifice gauge or choke 34, and is connected to the hydraulic circuit 10. The orifice gauge 34 delivers the control pressure differential for operation of the pressure regulator 26. The orifice gauge 34 is inserted into the hydraulic circuit 10 between the operating device 12 and the control valve 28.

The control valve 28 may be operated by a proportional pressure reducer 36. The outlet 38 of the proportional pressure reducer is connected to the pilot control circuit 40 of the control valve 28. The purpose of the pressure regulator 26 is to limit the pilot control pressure when the normal pressure differential is reached at the orifice gauge 34. In addition, the input 42 of the proportional pressure reducer 36 is connected at a connection point 44 in the hydraulic circuit 10. The connection point 44 opens into hydraulic circuit 10 between the orifice gauge 34 and the operating device 12. The hydraulic pump P with operating valve 22 may also open into this connection point 44 to the hydraulic circuit 10 or, as illustrated in FIG. 1, at an upstream point between the connection point 44 and the operating device 12. The output 38 of the proportional pressure reducer 36, as shown in FIG. 1, has another aperture 46. The characteristic of the proportional pressure reducer 36 may be adjusted. The reducer, in its switched position shown in FIG. 1, establishes a fluid conducting connection between the output 38 and a tank connection 48. In its other switched position, the reducer establishes a fluid conducting connection between input 42 and output 38. In addition, in its switched position shown in FIG. 1 the pressure regulator 26 assumes a blocking position in which the pilot control circuit 40 is blocked from another tank connection 50. In the other switched position of the pressure regulator 26, a fluid conducting connection is established between the pilot control circuit 40 and the other tank connection 50. In addition, an emergency drain function of the forklift is effected by a conventional blocking unit 52.

The pilot control valve 28 is represented by a pilot-controlled seat valve 54 with an aperture cross-section continuously variable as a function of the pilot control pressure. This valve is illustrated in FIG. 1 both by a switching symbol and by its actual internal structure. The pilot control is effected by way of a force transmitter 56 with a transmitting piston 58.

This force transmitter 56 is necessary to achieve full opening of the control valve 28 when the lift is lowered without a load (load pressures possibly<8 bar) for the lowest possible flow resistance. This arrangement satisfies the requirement for the load lowering function must be performed without the pump running, that is, the primary pressure supply of the proportional pressure reducer 36 can be provided only by tapping the load pressure. Consequently, the pilot control pressure may never be higher than the current lift pressure in lowering without a load. The piston side of the force transmitter 58 is connected to the pilot control circuit 40 so that fluid is conducted. The force transmitter rod side is connected to the tank so that fluid is conducted. In addition, the force transmitting piston 58 is connected by its control rod in operating connection to the other switching elements of the seat valve. Also acting on these other switching elements, in the direction opposite that of the force transmitting piston 58, is a pressure spring 60 whose pretensioning is set by means of the plug screw 62. The configuration for pilot-controllable seat valve 54 is conventional, and will not be described in detail at this point. In the switched position shown in the FIG. 1 the pilot-controllable seat valve 54 seals the operating device 12 off free of leakage from the tank connection T, in the manner of a seat valve. In the other switched position, the control aperture 64 with an aperture value continuously variable as a function of the pilot control pressure establishes the respective connection with a proportionally variable characteristic throttle curve.

The pressure regulator 26 in the pilot control circuit 40 is designed for low volume flows, such as ones of an order of magnitude of approximately 1 l/min. In addition, the pressure drop at the orifice gauge 34, especially one in the form of a measuring nozzle, is monitored by the pressure regulator 26. Pressure regulator 26 effects connection of the pilot control line of the seat valve 54 to the tank connection when the pilot pressure differential is reached, and thus prevents further increase in the lowering volume flow. The maximum lowering volume flow may be varied by changing the orifice gauge diameter. In addition, the maximum aperture cross-section selected for the control aperture 64 of the control valve 28 is very large in relation to the pilot control pressure limit of the pressure regulator 26. In particular, the aperture cross-section for the control aperture 64 of the control valve 28 is configured so that, with the pilot control pressure in the pilot control circuit 40 remaining the same, the lowering volume flow decreases with an increase in the load 18 on the operating device 12. In addition, both the output 66 of the pressure regulator 26 and the output 38 referred to above of the proportional pressure reducer 36 are introduced into the pilot control circuit 40 of the control valve 28. In addition, the input 42 of the proportional pressure reducer 36 and the control connection 30 are interconnected so as to conduct fluid as triggering input for the pressure regulator 26, by way of a branch-off point 68 in the hydraulic circuit 10.

The control device of the present invention uses the pilot-controlled seat valve 54 with control aperture 64 controlled by the proportional pressure reducer 36 for the maximum volume flow restriction required in the hydraulic circuit 10. The orifice gauge 34 in the form of a measuring nozzle is designed for a control differential pressure of only 3 to 4 bar at rated volume flow. The control differential pressure on the orifice gauge 34 is monitored by the pressure regulator 26 in the pilot control circuit 40 of the seat valve 54. When the predetermined control differential pressure is reached, the pressure regulator 26 opens into its switched position permitting flow of fluid, and thereby, limits the maximum pilot control pressure of the seat valve 54. The lift of the seat valve assumes a normal position for the purpose of maintaining the maximum volume flow. The respective layout permits increase in the volume flow during lowering without a load, so that obstacles to operation may not arise during lowering of the load fork 16. As is illustrated in FIG. 1, during the respective lowering movement the hydraulic pump P is separated from the hydraulic circuit 10 by the operating valve 22 being switched to the blocking position.

The maximum aperture cross-section selected for the seat valve with its control aperture 64 may be very large, since adjustment of the piston position is made by the pilot control pressure restriction of the pressure regulator 26. This arrangement also results in an additional increase in the lowering speed.

Figure 2:
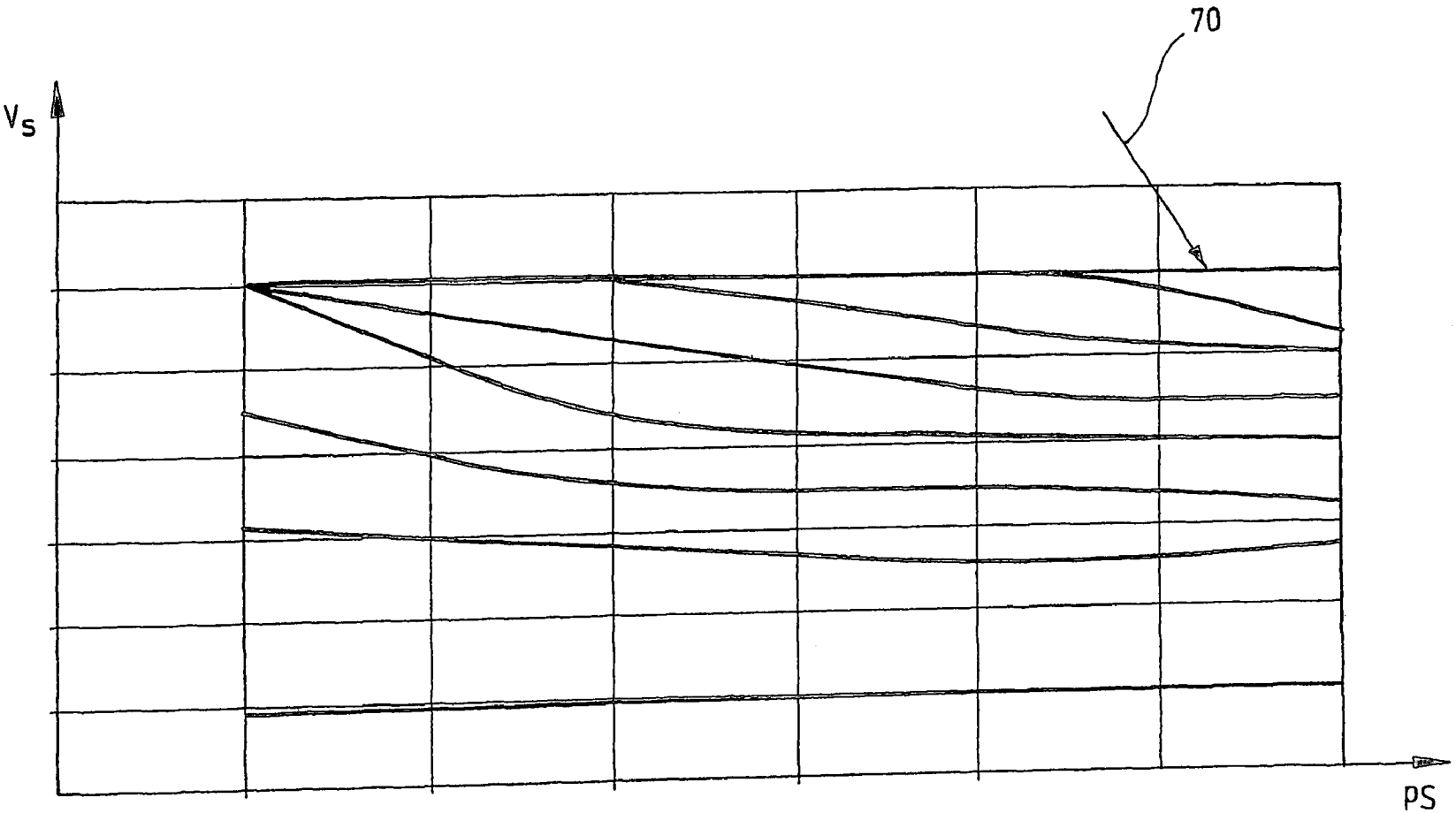
FIG. 2 is a graph illustrating the pattern of the respective lowering volume flow $V_s$ at constant pilot control pressure $p_s$(isobars)

In addition, the geometry of the seat valve 54 is configured so that with increased load pressure, the forces of flow require considerable increase in the pilot control pressure to achieve the same lift. The result is that the lowering volume flow drops with increase in the load under the same pilot control pressure. As a result, a system characteristic may be achieved such that the operator of the forklift requires greater adjusting distance for reaching the same lowering speed as the load increases. This respective degressive behavior favors good operation and also allows for safety aspects. The lowering volume flows $V_s$ at constant pilot control pressure $p_s$(isobars) are shown in FIG. 2. The line at the top FIG. 2, indicated by an arrow 70, reflects the maximum restriction by the pressure regulator 26.

Along with its original function of seat valve open at all times, the control aperture 64 of the control valve 28 is consequently assigned the additional function of control aperture of a constant flow control valve made up of orifice gauge 34, pressure regulator 26, and control aperture 64 for restriction of the maximum lowering speed. This arrangement results in a reduction of the functional surfaces present in the main volume flow of the lowering function and accordingly an increase in the lower speed without a load.

In contrast with the control differentials of >7 bar customarily assigned to constant-flow controllers, the constant-flow controller made up of orifice gauge 34, pressure regulator 26, and control aperture 64 with a control pressure differential of only 3 to 4 bar can ensure stable lowering. This arrangement leads to a greater measuring aperture diameter, something which also results in an increase in the lowering speed without load.

The control valve 28 is triggered by a force transmitter made up essentially of valve element 56 and piston 58. To permit load lowering even with the hydraulic pump switched off (conservation of energy especially in the case of battery operated devices), the primary connection of the proportional pressure reducer 36 is supplied by the load pressure of the lift function. The force transmitter 56 eliminates the problem that only an extremely low pilot control pressure (<7 bar depending on the lift mast design) is available for opening the control valve 28 in lowering with no load. Only use of the force transmitter 56 makes possible full opening of the control valve under all circumstances, and accordingly also extremely low flow resistance in lowering with no load.

Figure 3:
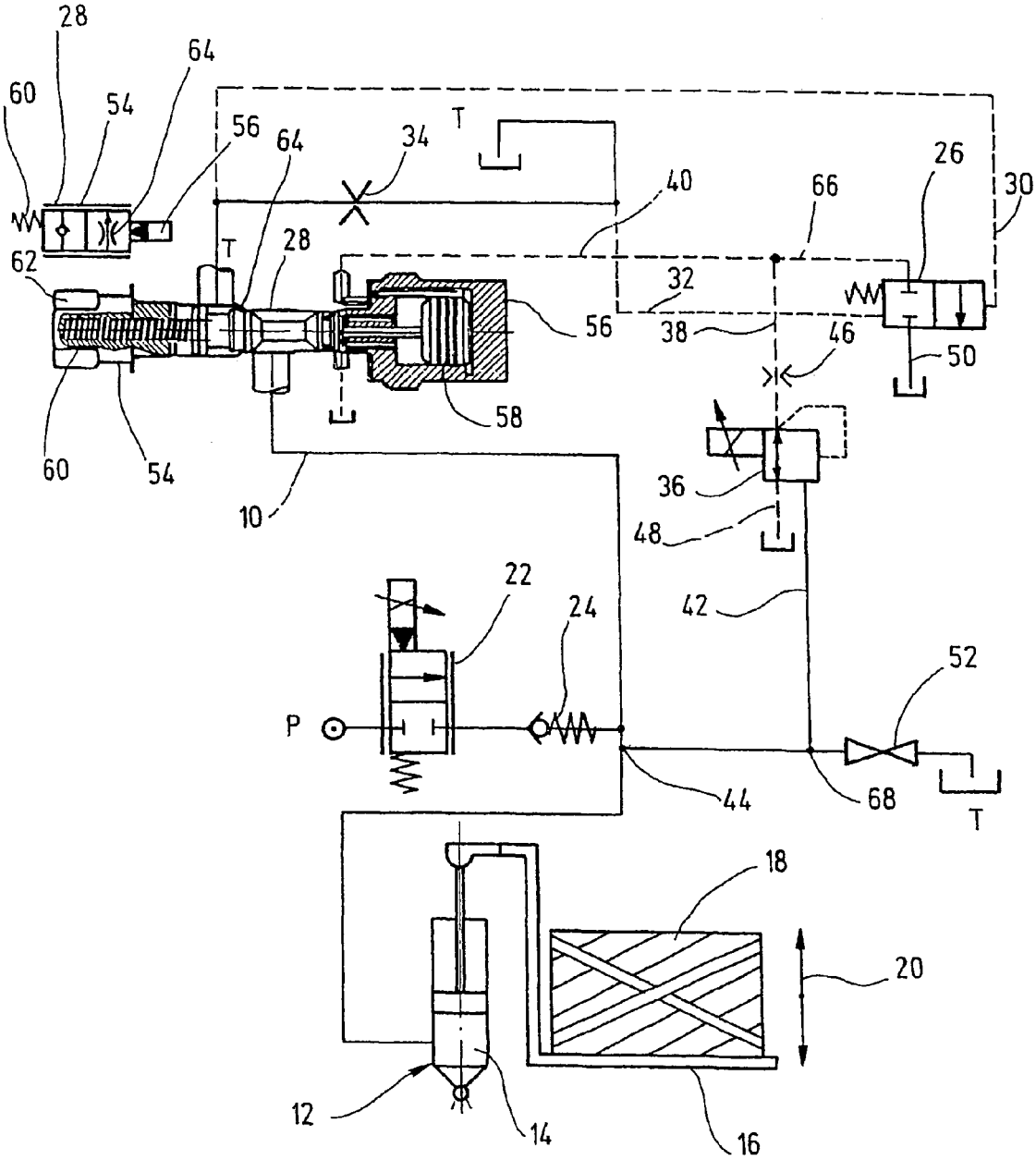
FIG. 3 is a schematic circuit diagram illustrating the circuitry of the control device shown according to a second embodiment of the present invention.

A second embodiment of the control device is illustrated in FIG. 3. The same components in FIG. 1 are identified by the same reference numbers, while the statements made in the foregoing also apply to the embodiment shown in FIG. 3. In addition, the embodiment shown in FIG. 3 is explained only to the extent that it differs significantly from the embodiment shown in FIG. 1.

In the embodiment shown in FIG. 3, the orifice gauge 34 is connected to a tank connection line, between the connection line T at the control valve 28 and the tank T. In addition, the first control connection 30 is mounted continuously between pressure regulator 26 and tank connection T of the control valve 28. As in the embodiment illustrated in FIG. 1, the second control connection 32 at one end is connected to the pressure regulator 26, and extends, as viewed in the direction of flow of fluid downstream from the orifice gauge 34, into the connecting line to the tank T at its other end. This configuration presents the advantage that all connections of the pressure regulator 26 extend through the valve seat 64, disconnected from the consuming device 12. Only the proportional pressure reducer valve 36 remains as a potential leakage point. However, it may be dimensioned in such a way that the leakage from this valve 36 is far below the lift density required. The configuration shown in FIG. 3 consequently allows almost leak-proof operation, and yet, very good control behavior for the device as a whole.

The device of the present invention need not be restricted to forklifts, but may also be applied to comparable problems. In addition, hydraulics may also be construed to include the use of pneumatic means.

The largely viscosity independent orifice gauge 34 may also be replaced by a corresponding orifice or a throttle with adjustable cross-section which provides the control pressure differential required for the pressure regulator 26.

The control device of the present invention represents a highly cost-effective, reliably operating system by means of which specific lowering movements may be executed by operating devices, and the triggering behavior may be regarded as stable. In addition, it is possible to permit a slower lowering speed with increasing load during operation of the control device. This capability complies with more rigid safety requirements.

While various embodiments have been chosen to illustrate the invention, it will be understood by those skilled in the art that various changes and modifications can be made therein without departing from the scope of the invention as defined in the appended claims.

What is claimed is:

1. A control devise for an operating device connected to a fluid circuit, comprising:

a control valve having a normal position during a lowering operation of the operating device under a load to maintain a predetermined maximum flow volume in the fluid circuit, and having a pilot control circuit;

an orifice gauge in the fluid circuit connected between said control valve and one of the operating device and a tank connection, said orifice gauge having a predetermined cross section providing a control pressure differential;

a pressure regulator connected to and limiting a pilot control pressure to said control valve to locate said control valve in the normal position, said pressure regulator being coupled by first and second control connections upstream and down stream, respectively, of said orifice gauge conveying the control pressure differential to actuate said pressure regulator; and a proportional pressure reducer having an output connected to said pilot control circuit and having an input connected to a connection point positioned between said control valve and the operating device.

2. A control device according to claim 1 wherein the fluid circuit is a hydraulic circuit.

3. A control device according to claim 2 wherein the operating device comprises an operating cylinder which raises and lowers a load fork.

4. A control device according to claim 1 wherein said orifice gauge is connected between said control valve and the operating device.

5. A control device according to claim 1 wherein said orifice gauge is connected between said control valve and a tank connection.

6. A control device according to claim 1 wherein said control valve is a pilot-controlled seat valve having a first position separating the operating device from a tank connection and a second position, corresponding to the normal position, connecting the operating device to the tank connection through a control aperture.

7. A control device according to claim 6 wherein said orifice gauge is a measuring nozzle having said control pressure differential thereof monitored by said pressure regulator.

8. A control device according to claim 6 wherein said control aperture of said control valve is very large due to a pilot pressure limitation effected by the predetermined maximum volume flow set by said pressure regulator.

9. A control device according to claim 8 wherein said control aperture of said control valve has a cross section determined to decrease lowering volume flow with increasing load on the operating device, while pilot control pressure remains constant.

10. A control device according to claim 1 wherein said pressure regulator is configured exclusively for low volume flows.

11. A control device according to claim 10 wherein said low volume flows are in an order of magnitude of one liter per minute.

12. A control device according to claim 1 wherein an output of said pressure regulator and said output of said proportional pressure reducer discharge into said pilot control circuit; and an input of said pressure regulator and said input of said proportional pressure regulator are connected in fluid communication.

* * * * *